United States Patent [19]

Moran

[11] 4,028,751

[45] June 14, 1977

[54] INTENSIVE CARE PORTABLE BATHTUB

[75] Inventor: Barber Moran, New Orleans, La.

[73] Assignee: The Raymond Lee Organization, Inc., New York, N.Y. ; a part interest

[22] Filed: June 30, 1975

[21] Appl. No.: 591,470

[52] U.S. Cl. ..... 4/173 R; 4/185 L; 4/185 S

[51] Int. Cl.[2] ..... A47K 3/12

[58] Field of Search .... 4/173, 177, 185 R, 185 AB, 4/185 L, 185 B, 185 S, 172.13; 242/67

[56] References Cited

UNITED STATES PATENTS

| | | | |
|---|---|---|---|
| 360,399 | 3/1887 | Worden | 242/67 |
| 2,504,287 | 4/1950 | Ward | 4/185 B |
| 2,850,743 | 9/1958 | White | 4/185 L |
| 3,496,577 | 2/1970 | Saldana | 4/173 X |
| 3,561,018 | 2/1971 | McVay | 4/185 L |
| 3,827,087 | 8/1974 | Cuthbertson | 4/173 X |

FOREIGN PATENTS OR APPLICATIONS

| | | | |
|---|---|---|---|
| 1,127,119 | 8/1956 | France | 4/185 L |

*Primary Examiner*—Richard E. Aegerter
*Assistant Examiner*—Stuart S. Levy
*Attorney, Agent, or Firm*—Daniel Jay Tick

[57] ABSTRACT

Rollers are rotatably affixed to the bottom of a housing. A sunken bathtub is mounted in the housing and extends from the top thereof. A pair of openings are provided in the top of the housing at opposite ends thereof. Each of a pair of shafts is positioned vertically in and extends through a corresponding one of the openings. A pair of guide devices for the shafts are provided in the housing. A support rod is affixed at its ends to the upper ends of the shafts outside the housing and is bent and extends within the bathtub. A duckboard is provided on the support rod in the bathtub. A control device in the housing is coupled to the shafts and extends from the housing for selectively raising and lowering the shafts to selectively raise and lower the duckboard via the support rod.

5 Claims, 4 Drawing Figures

INTENSIVE CARE PORTABLE BATHTUB

BACKGROUND OF THE INVENTION

The present invention relates to an intensive care portable bathtub. Objects of the invention are to provide an intensive care portable bathtub of simple structure, which is inexpensive in manufacture, utilized with facility and convenience, moved and carried with facility and convenience, utilized for bathing and massaging invalids and disabled people at home, in hospitals or in old age homes, and especially the intensive care units of hospitals, operated by a single attendant to bathe a person in any desired depth of liquid, has a minimum number of parts, and functions efficiently, effectively and reliably to provide intensive bathing, washing and massaging care to those unable to care for themselves.

BRIEF DESCRIPTION OF THE DRAWINGS

In order that the invention may be readily carried into effect, it will now be described with reference to the accompanying drawing, wherein.

Figure 1:
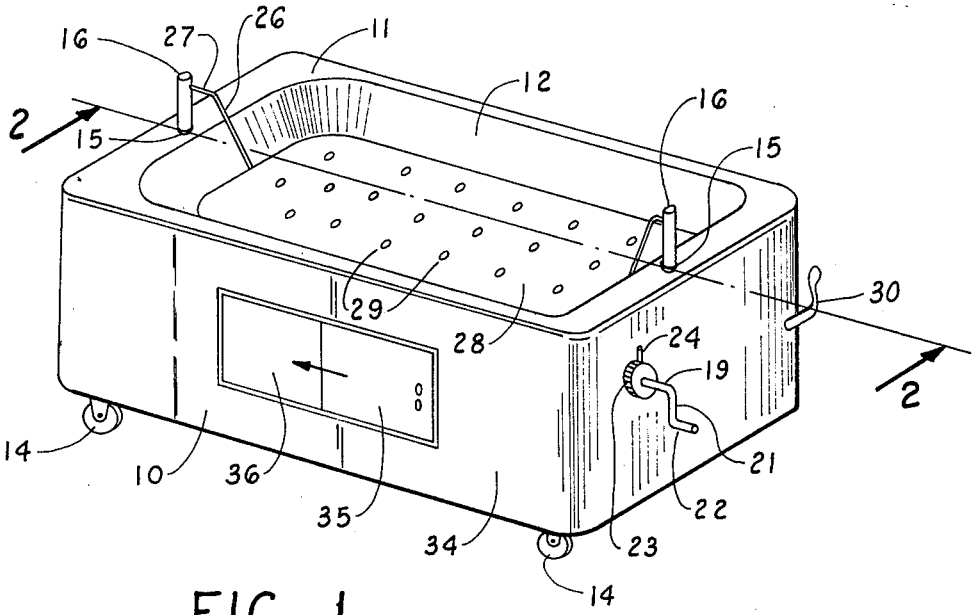
FIG. 1 is a perspective view of an embodiment of the intensive care portable bathtub of the present invention.
Figure 2:
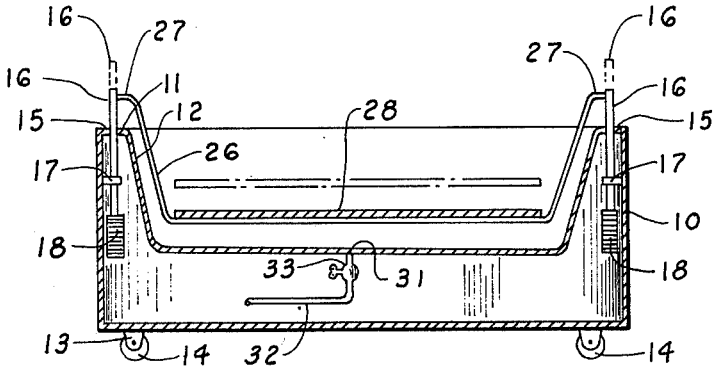
FIG. 2 is a vertical sectional view, taken along the lines II—II, of FIG. 1.
Figure 3:
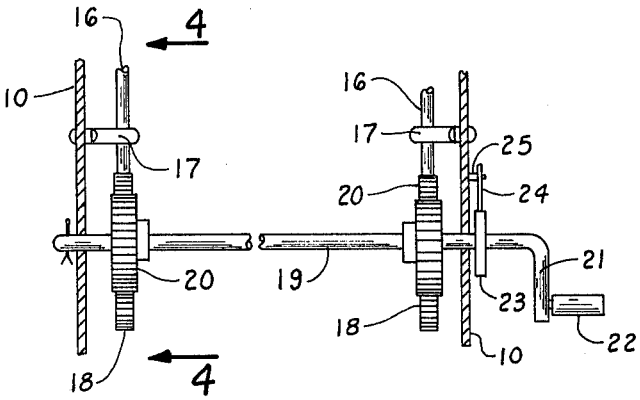
FIG. 3 is a view, on an enlarged scale, of the control device of the intensive care portable bathtub of the invention.
Figure 4:
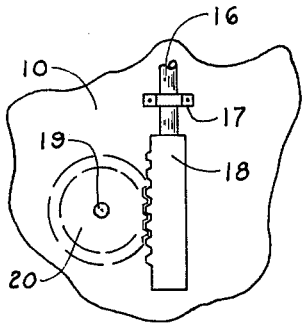
FIG. 4 is a view, taken along the lines IV—IV, of FIG. 3.

An open-bottomed housing 10, having the configuration of a rectantular parallelpiped, has a top 11 within which a sunken bathtub 12 is mounted. A flange 13 is formed along the lower edge of the housing 10. Casters 14 are mounted at the corners of the flange 13 for moving the tub about.

Opposite ends of the top 11 are provided with circular openings 15, within which are positioned vertical shafts 16. The shafts 16 extending downwardly through bearing brackets 17 suitably mounted at the end portions ofthe housing 10 at the interior thereof. A substantially linear gear 18 is fixedly connected to the lower end of each of the shafts 16.

A third, longitudinally extending, shaft 19 is journalled at opposite sides of the housing 10 in operative proximity with the linear gears 18. Gears 20 are affixed to, and rotate with, the third shaft 19. The gears 20 are in mesh with the gears 18. Thus, rotation of the shaft 19 selectively raises and lowers the shafts 16.

The shaft 19 extends beyond the side wall of the housing 10 to terminate in a laterally bent portion 21. A crank handle 22 is connected to the end of the shaft 19 outside the housing. A gear 23 is keyed to the extended outer end of the shaft 19 adjacent the outer surface of the housing 10. A vertical lock pin 24 is positioned for vertical movement within a bracket 25 affixed to the outside surface of the housing 10 and is provided with a pointed lower end adapted to engage the gear 23 to lock the shaft 19 against rotational movement.

A supporting rod 26 bent in a substantially trapezoidal configuration has substantially horizontally extending ends positioned within openings provided in the upper ends of the shafts 16. The center portion of the support rod 27 supports a duckboard 28 having perforations or holes 29 formed therethrough.

Straps 30 and additional straps (not shown in the FIGS.) are secured to opposite sides of the housing 10 for releasable connection to a bed of a person who is to be bathed, washed, massaged, or otherwise treated with or in liquid.

A drain 31 is provided at the center of the bottom of the bathtub 12. A hose 32 is coupled to the bathtub at the drain 31 and extends therefrom. A manually operated valve 33 is provided at the hose 32 for selectively opening and closing the drain 31.

An access opening is provided in a side 34 of the housing extending between the sides in which the shaft 19 is journalled. The housing provides access to the control device in the housing which device selectively raises and lowers the shafts 16 to selectively raise and lower the duckboard 28 via the support rod 26. A closing device, such as, for example, a pair of sliding doors 35 and 36, is provided for manually selectively opening and closing the access opening.

The duckboard 28 is selectively raised and lowered, by the selective rotation of the shaft 19 via its crank handle 22, to selectively raise and lower the patient within the tub. This enables a single attendant to raise and lower a patient in the bathtub 12 by rotation of the crank handle 22, and results in savings of time and time, labor and effort. The perforations or holes 29 through the duckboard 28 facilitate the raising and lowering thereof in water or other liquid in the bathtub. Since the duckboard 28 is supported by the support rod 26, said duckboard may be readily removed for cleaning purposes.

The sides of the housing 10 in which the ends of the shaft 19 are journalled, may be provided with stops to limit the downward movement of the shafts 16. Furthermore, a rubber hose may be utilized to supply water from a faucet, container, or other source of water, into the bathtub 12.

The intensive care portable bathtub of the invention is movable to a desired location alongside the bed of a patient or any resting place of the patient, by means of the casters 14. The housing 10 is releasably affixed to the bed by the straps 30, and so on. The duckboard 28 is then raised by means of the crank handle 22. The patient is transferred to the duckboard 28 and said duckboard is lowered to a desired position via the crank handle 22.

The portable bathtub of the invention thus enables a disabled patient to have a tub bath alongside his bed. A patient is adequately attended to by a single attendant, thereby eliminating the need for two or three attendants to carry a patient from his bed to a bathtub. This also, therefore, saves wear and tear on the patient as well as on the attendants. The portable bathtub of the invention is manufactured economically, due to its simple mechanism. The portable bathtub of the invention may comprise any suitable material such as, for example, aluminum, galvanized tin, plastic, or the like, and should be included in standard hospital supplies and in private and old age homes.

While the invention has been described by means of a specific example and in a specific embodiment, I do not wish to be limited thereto, for obvious modifications will occur to those skilled in the art without departing from the spirit and scope of the invention.

I claim:

1. An intensive care portable bathtub, comprising a housing having a top, a bottom and sides;

roller means rotatably affixed to the bottom of the housing;

a sunken bathtub mounted in the housing and extending from the top thereof;

a pair of openings in the tip of the housing at opposite ends thereof;

a pair of shafts each positioned substantially vertically in and extending through corresponding one of the openings;

a pair of guide means for the shafts in the housing;

a support rod affixed at its ends to the upper ends of the shafts outside the housing, said support rod being bent and extending within the bathtub;

a perforated duckboard on the support rod in the bathtub; and control means in the housing coupled to the shafts and extending from the housing for selectively raising and lowering the shafts to selectively raise and lower the duckboard via the support rod, wherein said control means further comprises a pair of substantially linear gears each affixed to a corresponding one of the shafts in the housing, a third longitudinally extending shaft having opposite ends journalled in opposite sides of the housing, one end of the third shaft extending out of the housing, a pair of longitudinally spaced gears affixed to the third shaft in the areas of the opposite ends thereof, said gears being rotatable with said third shaft, each of said gears being drivably coupled to a corresponding one of the substantially linear gears, and crank handle means affixed to the end of the third shaft outside the housing.

2. An intensive care portable bathtub as claimed in claim 1, further comprising an access opening in one of the sides of the housing for providing access to the control means in the housing and closing means for manually selectively opening and closing the access opening.

3. An intensive care portable bathtub as claimed in claim 1, further comprising a drain in the bottom of the bathtub, a hose coupled to the bathtub at the drain and extending therefrom and valve means at the hose for selectively opening and closing said drain.

4. An intensive care portable bathtub as claimed in claim 1, further comprising strap means for releasably securing the housing to a bed.

5. An intensive care portable bathtub as claimed in claim 1, further comprising a third gear affixed to the third shaft outside the housing and rotatable with said third shaft adjacent a side of the housing, a bracket affixed to the side of the housing and extending therefrom in operative proximity with the third gear, and a pin movably mounted in the bracket for movement in directions substantially perpendicular to the axis of the third shaft whereby when said pin is moved into engagement with said third gear said third shaft is locked in position and locks said pair of shafts in position and when said pin is moved out of engagement with said third gear said third shaft is freely rotatable to selectively move said pair of shafts.

* * * * *